United States Patent [19]

Kadim

[11] 4,391,055

[45] Jul. 5, 1983

[54] AMMUNITION MAGAZINE

[75] Inventor: Azriel Kadim, Tel Aviv, Israel

[73] Assignee: Orlite Engineering Ltd., Nes Ziona, Israel

[21] Appl. No.: 170,087

[22] Filed: Jul. 18, 1980

[51] Int. Cl.[3] ..... F41C 25/02

[52] U.S. Cl. ..... 42/50

[58] Field of Search ..... 42/50, 71 P; 89/36 A

[56] References Cited

U.S. PATENT DOCUMENTS

| | | | |
|---|---|---|---|
| 2,758,952 | 8/1956 | Toulmin, Jr. | 89/36 A |
| 3,732,643 | 5/1973 | Wells | 42/50 |
| 4,107,862 | 8/1978 | Sofinowski | 42/50 |
| 4,132,024 | 1/1979 | Pachmayr et al. | 42/71 P |

FOREIGN PATENT DOCUMENTS

| | | | |
|---|---|---|---|
| 1359028 | 3/1964 | France | 42/50 |
| 875222 | 8/1961 | United Kingdom | 42/50 |

*Primary Examiner*—Charles T. Jordan

*Attorney, Agent, or Firm*—Cushman, Darby & Cushman

[57] ABSTRACT

An ammunition magazine formed of plastic and including a housing defining an opening, a bullet support plate located in the housing, a spring disposed in the housing and underneath the support plate for urging bullets towards the opening, the opening being configured to provide retention of bullets located in the housing; and reinforcing associated with the housing adjacent the opening for preventing fracture of the housing upon impact.

5 Claims, 1 Drawing Figure

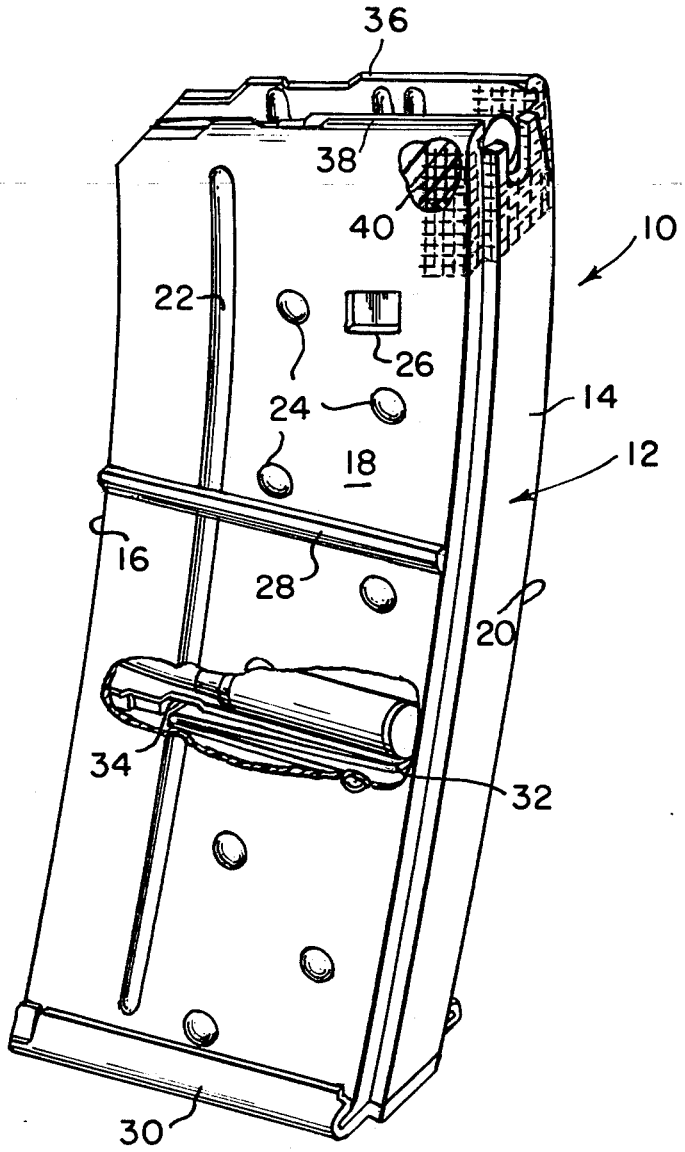
36
38
40
10
22
26
24
14
18
12
16
28
20
34
32
30

AMMUNITION MAGAZINE

FIELD OF THE INVENTION

The present invention relates to articles manufactured of high strength plastic, and more particularly to an ammunition magazine constructed of such material.

BACKGROUND OF THE INVENTION

Modern firearms, such as the M-16 and other weapons, employ magazines for storage and loading of ammunition into the weapon. Metal magazines are well known for this purpose. Metal magazines have several disadvantages including corrosion and their tendency to become dented and bent when dropped in a fully loaded condition. Such deformations can have serious consequences for the operation of the firearm and can result in jamming under battle conditions.

For these reasons and also for reasons of economy and efficiency in production, magazines formed of plastic have been developed. These have been found to be unsatisfactory since they tend to crack particularly at their top end edges when dropped in a fully loaded condition.

SUMMARY OF THE INVENTION

The present invention seeks to overcome disadvantages of the prior art magazines made of plastic and to provide a magazine that is not damaged when dropped in a loaded condition and which is relatively economical to manufacture.

There is thus provided in accordance with the present invention an ammunition magazine comprising a housing formed of plastic, one end of the magazine being normally closed and the other end of the magazine being normally opened for insertion and removal of ammunition from the interior of the housing and wherein at least a portion of the side wall of the housing adjacent the open end is reinforced with the use of a material different from that used to form the housing.

Further in accordance with an embodiment of the present invention, the reinforcing material may be a mesh formed of metal or fiber threads and may be moulded into the housing wall at the time of its formation. Alternatively, the reinforcing material may be a solid or perforated metal element such as a plate.

BRIEF DESCRIPTION OF THE DRAWING

The present invention will be more fully understood and appreciated from the following detailed description taken in conjunction with the drawing in which FIG. 1 is a partially cut-away pictorial illustration of a magazine constructed and operative in accordance with an embodiment of the present invention.

DETAILED DESCRIPTION OF THE INVENTION

Referring now to FIG. 1 there is seen a magazine 10 constructed and operative in accordance with an embodiment of the present invention and comprising a housing 12 of generally curved configuration and generally rectangular cross section. Housing 12 comprises curved back and front end walls 14 and 16 which are integrally formed with generally planar side walls 18 and 20. Various recesses 22, 24 and 26 are formed in the side walls 18 and 20 to facilitate mating of the magazine inside of a firearm for use with which the magazine is designed. A projection 28 is formed on side wall 18 to act as a stop member for defining the maximum insertion of the magazine into the firearm.

It is appreciated that there are a large number of different constructions of firearms and therefore the details of the configuration and construction of the corresponding magazines suitable for use therewith will vary. The present invention is directed not at any particular construction of magazine for any particular type of firearm but rather the invention is concerned with design elements which are common to all such magazines.

The bottom opening of the housing 12 is normally closed by a closure 30 which snaps and slides over the end of the housing and is removable to permit cleaning of the interior thereof. Over the closure 30, which acts also as a spring seat there is disposed a spring 32 of generally rectangular cross section which supports a base plate 34 and urges it upward towards the top opening of the housing. Base plate 34 is conventionally formed to define a seat for a single bullet, such that the bullets became aligned in the housing in a desired regular pattern.

The remaining quantity of bullets are stacked above the base plate 34 in the housing up to the top opening thereof and are prevented from escaping by the top construction of the magazine in which top side edges 36 and 38 are curved inwardly to engage the bullets.

According to a preferred embodiment of the invention the top region of the magazine is reinforced by employing a mesh 40 typically formed of wire threads which is molded integrally with the housing and extends from side wall 18 to side wall 20 and through end wall 14, thus strengthening the bond between these walls adjacent the top opening. According to an alternative embodiment of the invention, the reinforcing may continue entirely around the top region of the magazine or at both top corners thereof or in any other desired configuration. As a further alternative any other suitable type of reinforcing material or structure may be employed, such as the use of individual bands or fibers of any suitable reinforcing material, integrally formed strengthened portions of the housing walls, or solid or perforate metal elements.

It is a particular feature of the present invention that the magazine is reinforced adjacent its upper corner adjacent the back of the bullets, since this is the region that receives the impact of the stored bullets when the magazine is dropped.

It will be appreciated by persons skilled in the art that the invention is not limited to what has been particularly shown and described hereinabove. Rather the scope of the invention is defined only by the claims which follow:

I claim:

1. An ammunition magazine formed of plastic and comprising:

a housing defining a pair of side walls and front and rear edge walls joining said pair of side walls, said housing defining an opening;

a bullet support plate located in said housing;

a spring disposed in said housing and underneath said support plate for urging bullets towards said opening, said opening being configured to provide means for retention of bullets located in said housing; and reinforcing means in the form of a reinforcing web moulded into said housing and spanning said rear edge wall and parts of said pair of side walls adjacent thereto in a region adjacent said opening for preventing fracture of said housing upon impact.

2. A magazine according to claim 1 and wherein said reinforcing means comprises a mesh.

3. A magazine according to claim 1 and wherein said reinforcing means comprises a perforated plate.

4. A magazine according to claim 1 and wherein said reinforcing means comprises metal threads.

5. A magazine according to claim 1 and wherein said reinforcing means comprises a metal mesh which is moulded integrally with said housing.

* * * * *